US007293389B2

(12) United States Patent
Jacobs

(10) Patent No.: US 7,293,389 B2
(45) Date of Patent: Nov. 13, 2007

(54) SELF ALIGNING TOP GUIDE WHEEL FOR SLIDING DOORS

(75) Inventor: Kenneth Jacobs, Guildford (GB)

(73) Assignee: Home Decor Holding Company, Charlotte, NC (US)

( * ) Notice: Subject to any disclaimer, the term of this patent is extended or adjusted under 35 U.S.C. 154(b) by 222 days.

(21) Appl. No.: 11/062,755

(22) Filed: Feb. 23, 2005

(65) Prior Publication Data

US 2005/0246962 A1 Nov. 10, 2005

Related U.S. Application Data

(60) Provisional application No. 60/547,424, filed on Feb. 26, 2004.

(51) Int. Cl.
*E05D 13/00* (2006.01)

(52) U.S. Cl. ..... 49/425; 49/417; 49/418; 16/91; 16/93 R; 16/99

(58) Field of Classification Search ..... 49/409, 49/410, 414, 417, 418, 420, 425; 16/91, 16/93 R, 99
See application file for complete search history.

(56) References Cited

U.S. PATENT DOCUMENTS 2,827,957 A * 3/1958 Haws ..... 160/199
3,397,487 A * 8/1968 Hunt et al. ..... 49/130
3,416,183 A * 12/1968 Martin ..... 16/105
3,722,028 A * 3/1973 Schoenbrod ..... 16/91
3,826,044 A * 7/1974 Armstrong ..... 49/420
4,014,378 A * 3/1977 Kochanowski ..... 160/186
4,064,593 A * 12/1977 Helmick ..... 16/105
5,860,189 A * 1/1999 An ..... 16/91
6,449,906 B1 9/2002 Jacobs

* cited by examiner

*Primary Examiner*—Jerry Redman

(57) ABSTRACT

A sliding door assembly includes a sliding door that is slidingly mounted to a top track via one or more top guide assemblies. The sliding door is also slidingly mounted to a bottom track. Each top guide assembly includes a top guide wheel that rotationally mounts to the top guide assembly and engages the top track to guide the sliding door. The guide wheel rotates relative to the top guide assembly about an axis that extends horizontally in a direction perpendicular to a direction of travel of the sliding door. The guide wheel also movably mounts to the top guide assembly so that the guide wheel moves upwardly and downwardly relative to the top guide assembly and sliding door to correct for any variation in the gap between the top and bottom tracks.

8 Claims, 3 Drawing Sheets

300
330
350
120
300
310
320

120
350
370
370

120
350
330
4D
4D
360

110
340
340
3C
3C
210
200
210
220

380
370
320
310
220
120
360
350
330
300

110
340
220
210
230

230
340
110
210

SELF ALIGNING TOP GUIDE WHEEL FOR SLIDING DOORS

CROSS REFERENCE TO RELATED APPLICATION

This application claims priority to U.S. Provisional Application No. 60/547,424, filed Feb. 26, 2004, the entire contents of which are incorporated by reference.

BACKGROUND OF THE INVENTION

1. Field of the Invention

This invention relates generally to sliding doors, and more specifically to top guides for guiding sliding doors along top tracks.

2. Description of Related Art

Sliding panel doors, such as those used in closets, are constructed from thin panels that gain rigidity from the application of a perimeter frame formed by two side, one top, and one bottom roll formed or extruded metal sections that are mechanically joined at each corner by means of a metal or plastic joining plate. The weight of the panel door is typically supported by a bottom track, and the door is provided with wheels or other slidable elements that can slide or roll within the bottom track. The top portion of the door is often retained and guided in a top "E" section track, which provides downwardly depending leg portions defining vertical surfaces in which the upper portion of the panel door is retained and guided. Particularly, the upper portion of the panel door is typically provided by a top guide assembly that is attached to the metal or plastic frame joining plate at each top corner of the door. The top guide assembly typically includes a pair of top guide wheels (or rollers or other slidable elements) each rotatable about a vertical axis. As the door travels along the bottom and top tracks, the top guide wheels rotate against the inside parallel vertical edges of the E track and keep the sliding door positioned centrally within the track cavity. U.S. Pat. No. 6,449,906 illustrates one such conventional top guide and is incorporated herein by reference in its entirety.

When the top and bottom tracks are perfectly parallel and the top guide assemblies are properly mounted to the sliding door, the top guide wheel axes are perfectly perpendicular to the direction of travel of the sliding door, and the top guide wheels roll smoothly along the inside parallel vertical edges of the top E track. However, in some installations, the top and bottom tracks are not perfectly parallel to each other (i.e., the top and bottom tracks angle toward each other) due to variations and imperfections in the floor, ceiling, or other substrate onto which the tracks are mounted. These imperfections may occur over time with the settling of the building or structure. When the top and bottom tracks are so skewed, the top guide wheel axes will not be perpendicular to the direction of travel of the sliding door, which follows the bottom track. Such a misalignment of the top guide wheel axis relative to the direction of travel of the sliding door may also result from a misaligned attachment of the top guide assembly to the sliding door. Consequently, the natural rolling path of the top guide wheels will be skewed relative to the actual direction of travel of the sliding door. The skewed path over which the top guide wheels roll causes the top guide wheels to vibrate or jitter as they attempt to follow their natural path, but are forced to follow the actual path of the sliding door. This vibration often generates noise.

SUMMARY OF THE INVENTION

Accordingly, one aspect of one or more embodiments of this invention provides a top guide assembly that operates quietly, smoothly, and effectively, even when the top and bottom tracks are not parallel to each other or the top guide is not perfectly positioned on the sliding door.

Another aspect of one or more embodiments of the present invention provides a sliding door assembly that includes a sliding door panel and a guide arm movably connected to an upper portion of the sliding door panel. The guide arm is movable relative to the sliding door panel in a vertical direction. The sliding door assembly also includes a top guide wheel pivotally connected to the guide arm at a top guide wheel axis. The guide wheel moves with the guide arm relative to the sliding door panel.

According to a further aspect of one or more of these embodiments, the movable connection between the guide arm and the sliding door panel is a pivotal connection that defines a guide arm axis. The guide arm axis is spaced from the top guide wheel axis. The top guide wheel axis extends in a lateral, horizontal direction relative to the sliding door panel. The top guide wheel axis and guide arm axis are parallel to each other. An interference between the guide arm and the sliding door panel limits the range of the pivotal movement of the guide arm relative to the sliding door panel.

The sliding door assembly may further include a top guide base mounted to the upper portion of the sliding door panel. The guide arm pivotally connects to the sliding door panel by way of a pivotal connection between the guide arm and the top guide base.

According to a further aspect of one or more embodiments, the sliding door assembly also includes a spring operatively extending between the top guide base or the sliding door panel and the guide arm to bias the guide arm and top guide wheel upwardly away from the sliding door panel.

The assembly may also include an elongated top track adapted to be mounted to a substrate. The top track has an elongated guide wheel channel. The top guide wheel extends into the channel so that the channel guides the movement of the guide wheel along the top track. The channel has opposing sides that provide lateral support to the sliding door panel by way of the top guide wheel.

An additional aspect of one or more embodiments of the present invention provides a top guide assembly for mounting a sliding door panel to a top track. The top guide assembly includes a top guide base adapted to be mounted to an upper portion of the sliding door panel. The top guide assembly also includes a guide arm movably connected to the top guide base. The guide arm is movable relative to the top guide base in a vertical direction. The top guide assembly also includes a top guide wheel pivotally connected to the guide arm at a top guide wheel axis. The guide wheel moves with the guide arm relative to the top guide base.

According to a further aspect of one or more embodiments of this invention, an interference between the guide arm and the top guide base limits the pivotal movement of the guide arm relative to the top guide base.

According to a further aspect of one or more of these embodiments, the guide arm pivots about a first axis and the top guide wheel axis is spaced from the first axis.

According to a further aspect of one or more of these embodiments, the movable connection between the guide arm and the sliding door panel allows the guide arm to move in a linear, vertical direction relative to the sliding door panel.

Additional and/or alternative advantages and salient features of the invention will become apparent from the following detailed description, which, taken in conjunction with the annexed drawings, disclose preferred embodiments of the invention.

BRIEF DESCRIPTION OF THE DRAWINGS

Referring now to the drawings which from a part of this original disclosure.

DETAILED DESCRIPTION OF PREFERRED EMBODIMENTS

Figure 1:
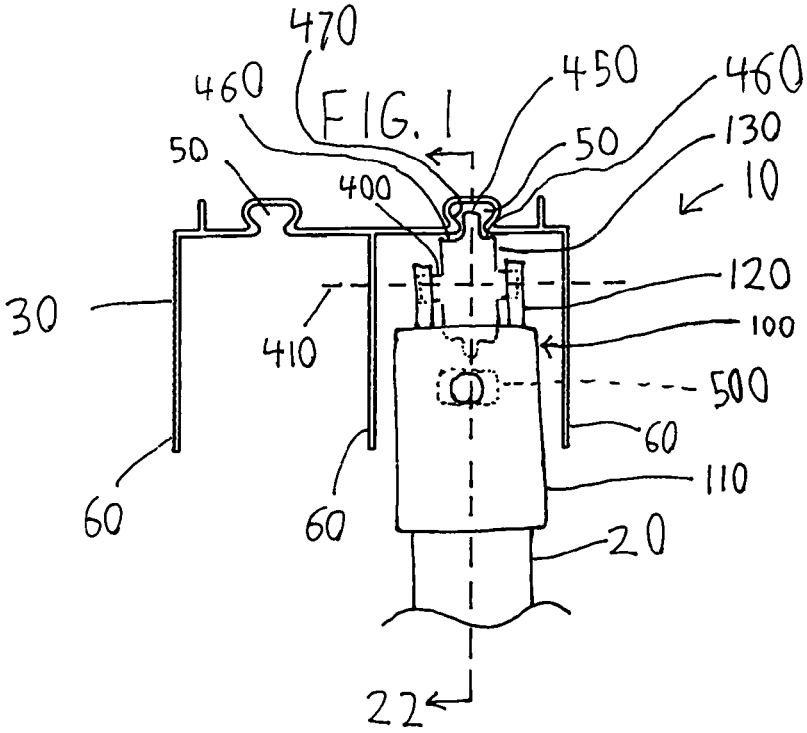
FIG. 1 is a partial front view of a sliding door assembly according to one embodiment of the present invention.

FIG. 1 shows a sliding door assembly 10 according to a preferred embodiment of the present invention. The sliding door assembly 10 includes at least one sliding door or door panel 20, a top E track 30, and a top guide assembly 100 that connects the sliding door 20 to the top track 30 to guide the sliding door 20 along the top track 30. The sliding door assembly 10 may also include a second sliding door 20 (not shown) operatively connected to the top track 30 via a second top guide assembly 100. One top guide assembly 100 is preferably provided for each end (front and back as shown in FIG. 1) of the sliding door 20. The sliding door assembly 10 also includes a bottom track (not shown) and at least one bottom guide assembly (not shown) that connects the sliding door 20 to the bottom track. The top track 30 and bottom track are secured to a substrate (e.g., floor, ceiling, house frame, etc.) in a parallel, vertically spaced relationship.

Figure 2:
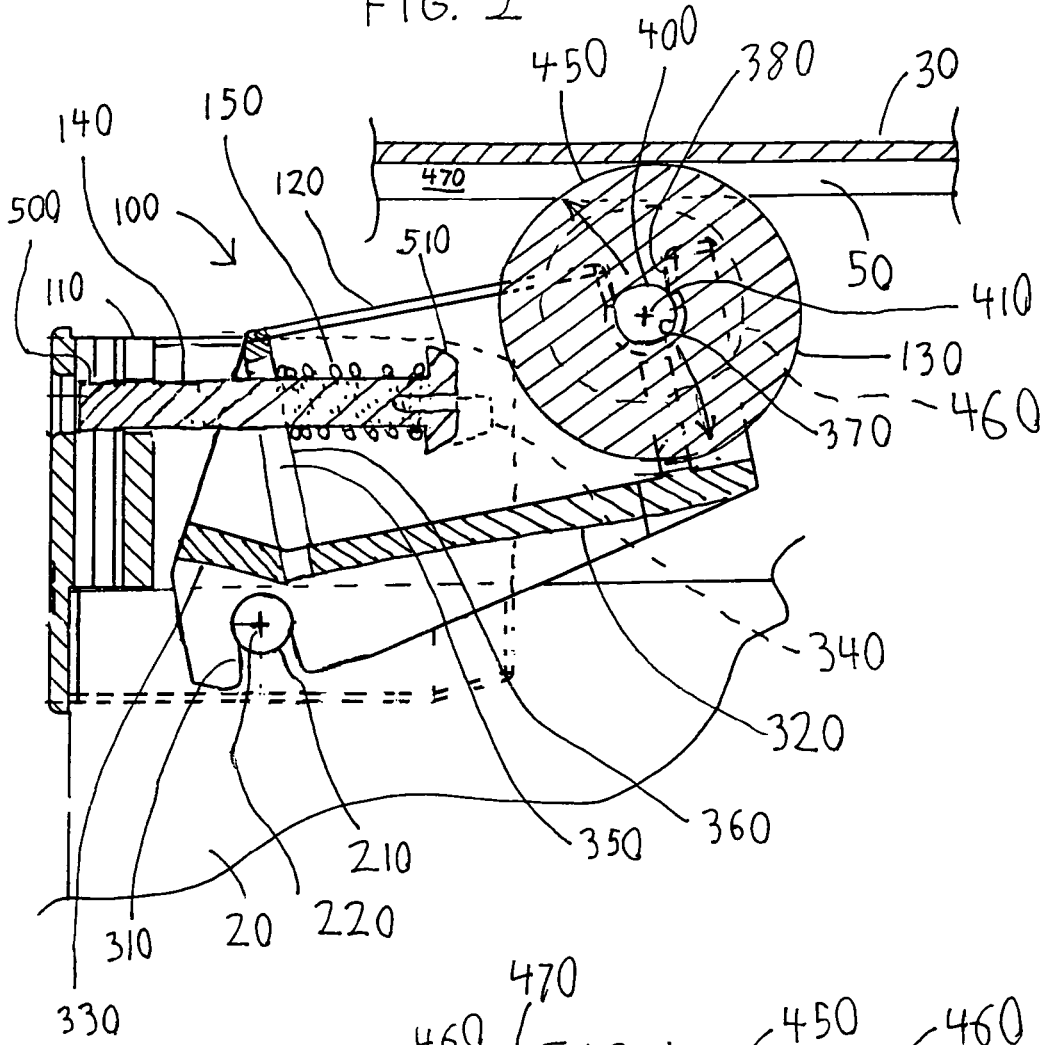
FIG. 2 is a cross-sectional view of a top guide assembly in FIG. 1, taken along the line 2-2 in FIG. 1.

As shown in FIGS. 1 and 2, the top track 30 is an elongated structure. The top track 30 has two elongated, parallel, running channels 50. The running channels 50 are designed to engage the top guide assembly 100 along the top track 30. It is contemplated that three or more running channels 50 could be provided, depending on the number of sliding doors 20. As shown in FIG. 1, the top track 30 also includes three downwardly projecting legs 60 that create an "E" shape. The legs 60 hide the top guide assembly 100 from view, discourage foreign objects from interfering with the operation of the top guide 100, and guide the sliding door 20 if the top guide assembly 100 disengages from the channel 50.

As shown in FIG. 2, the top guide assembly 100 includes a top guide base 110, a guide arm 120, a guide wheel 130, a spring pin 140, and a spring 150.

Figure 3B:
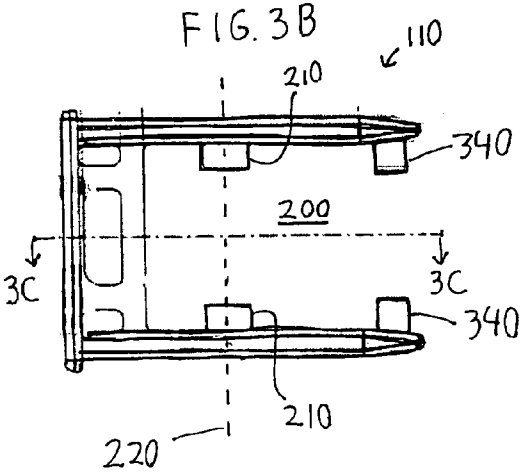
FIG. 3B is a bottom view of the top guide base in FIG. 3A.

As shown in FIGS. 1 and 2, the top guide base 110 mounts to an upper portion of the sliding door 20. As shown in FIG. 3B, the top guide base 110 has a channel 200 that is press fit onto an upper corner of the sliding door 20 (see FIG. 2). Alternatively, the top guide base 110 may be secured to the sliding door 20 in any other suitable fashion (e.g., screws, glue, bolts, etc.). Alternatively, the top guide base 110 may be integrally formed with the sliding door 20.

Figure 3C:
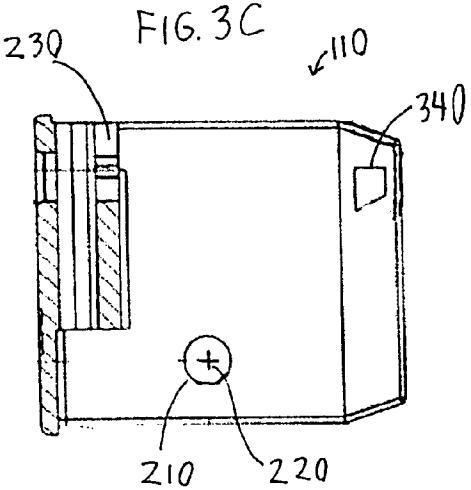
FIG. 3C is a side cross-sectional view of the top guide base in FIG. 3A, taken along the line 3C-3C in FIG. 3B.

As shown in FIGS. 2, 3B, and 3C, two guide arm axles 210 are formed on an inside portion of the top guide base 110 and extend into the channel 200. The guide arm axles 210 define a guide arm axis 220. Inner axial ends of the guide arm axles 210 abut the sliding door 20 when the top guide base 110 is mounted to the sliding door 20. The guide arm axis 220 extends laterally (or horizontally) relative to the sliding door 20 in a direction that is perpendicular to a direction of travel of the sliding door 20.

Figure 3A:
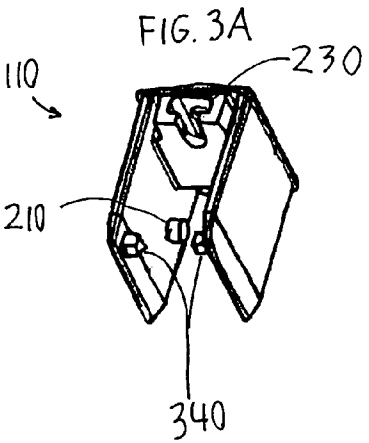
FIG. 3A is a top perspective view of a top guide base of the top guide assembly in FIG. 2.

As shown in FIG. 3A, the top guide base 110 includes a mounting slot 230 that is adapted to securely engage an enlarged head 500 of the spring pin 140 (see FIGS. 1 and 2).

Figure 4B:
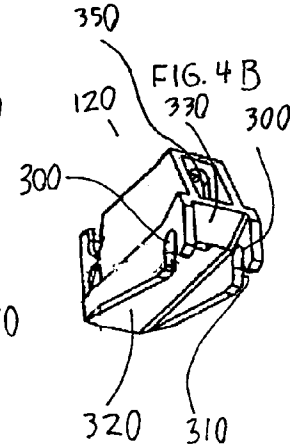
FIG. 4B is a lower perspective view of the guide arm in FIG. 4A.
Figure 4A:
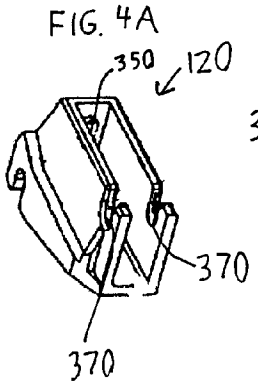
FIG. 4A is an upper perspective view of a guide arm of the top guide assembly in FIG. 2.
Figure 4C:
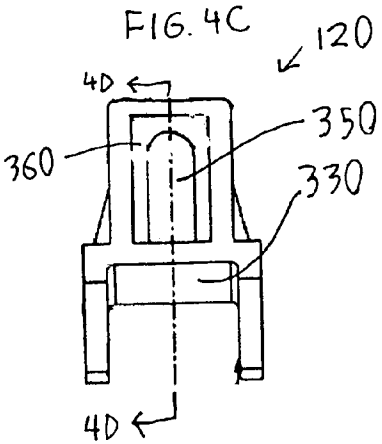
FIG. 4C is a front view of the guide arm in FIG. 4A.
Figure 4D:
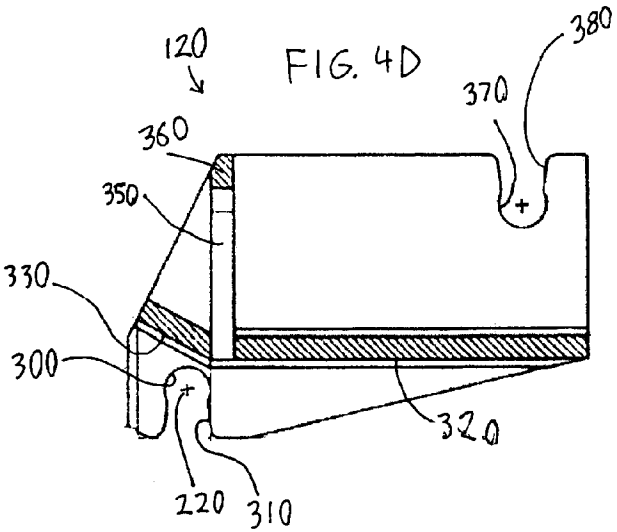
FIG. 4D is a side cross-sectional view of the guide arm in FIG. 4A, taken along the line 4D-4D in FIG. 4C.

As shown in FIGS. 2, 4B, and 4D, the guide arm 120 has a laterally extending bore 300. As shown in FIGS. 2 and 4D, a laterally extending slot 310 extends between the bore 300 and a lower perimeter of the guide arm 120. The guide arm 120 pivotally connects to the top guide base 110 when the slot 310 and bore 300 are press fit over the axles 210 so that the bore 300 is concentric with the axles 210 (see FIG. 2). The slot 310 is slightly narrower than the outside diameter of the axles 210 so that the slot 310 holds the axles 210 in the bore 300. The bore 300 has an inside diameter that is slightly larger than the outside diameter of the axles 210 of the top guide base 110 so that the guide arm 120 can freely pivot relative to the top guide base 110 about the guide arm axis 220.

As shown in FIG. 2, the range of pivotal movement of the guide arm 120 relative to the top guide base 110 and sliding door 20 is limited by lower portions 320, 330 of the guide arm 120, which abut a top edge of the sliding door 20 when the guide arm 120 reaches its extreme pivotal positions. As shown in FIGS. 2, 3A, 3B, and 3C, two catch plates 340 formed on the inside of the top guide base 110 and a middle portion 360 of the guide arm 120 also limit the range of pivotal movement of the guide arm 120 relative to the top guide base 110.

As shown in FIGS. 2, 4A, 4B, 4C, and 4D, a through slot 350 is formed in the middle portion 360 of the guide arm 120 and is designed to slide over the spring pin 140.

As shown in FIGS. 2, 4A, and 4D, a laterally extending guide wheel bore 370 is formed in an upper portion of the guide arm 120. A laterally extending slot 380 connects the bore 370 to an upper edge of the guide arm 120.

As shown in FIGS. 1 and 2, the guide wheel 130 has a laterally extending axle 400 that defines a guide wheel axis 410. The guide arm axis 220 and the guide wheel axis 410 are parallel to and spaced from each other. The guide wheel 130 pivotally connects to the guide arm 120 when the guide wheel axle 400 is press fit into the slot 380 and bore 370 of the guide arm 120 so that the bore 370 is concentric with the axle 400. The slot 380 is slightly narrower than the outside diameter of the axle 400 so that the slot 380 holds the axle 400 in the bore 370. The bore 370 has an inside diameter that is slightly larger than the outside diameter of the axle 400 so that the guide wheel 130 can freely rotate relative to the guide arm 120 about the guide wheel axis 410.

While the pivotal connection between the top guide base 110 and guide arm 120 and the rotational connection between the guide arm 120 and the guide wheel 130 comprise axles that are press fit into slotted bores, a variety of other pivotal/rotational connections may alternatively be used. For example, a bolt could be used as an axle and fit through aligned bores in the top guide base and guide arm. A similar bolt axle could be used to pivotally connect the guide arm to the guide wheel. Various other rotational joints that would be known to those of ordinary skill in the art may alternatively be used without deviating from the scope of the present invention.

As shown in FIGS. 1 and 2, the guide wheel 130 includes a central circumferential ridge 450 surrounded by two circumferential shoulders 460. The circumferential ridge 450 fits into the channel 50 formed in the top track 30. Opposing inner sides 470 of the channel 50 provide lateral support to the guide wheel 130 to prevent the guide wheel 130 and the sliding door 20 from moving laterally relative to the channel 50. The circumferential edges of the shoulders 460 abut and roll along the top track 50. Alternatively, a circumferential edge of the ridge 450 may abut and roll along the top middle of the channel 50.

The top guide base 110, guide arm 120, and guide wheel 130 are molded and machined parts that preferably comprise a strong light material such as acetal homopolymer, nylon, plastic, etc. The axles 400, 210 and bores 300, 370 are preferably polished so that the rotational joints facilitate smooth pivotal movement.

As shown in FIGS. 1 and 2, the spring pin 140 has an enlarged head 500 that is secured in the slot 230 formed in the top guide base 110. Alternatively, the spring pin 140 can have a threaded end that mates with complementary threads on the slot 230. An opposite end of the spring pin 140 has two radially extending, spaced flanges 510. The spaced flanges 510 form a stop for the compression spring 150. The flanges 510 are flexible so that they can be pressed together to reduce their combined outer diameter. The spring pin 140 may be integrally formed with the top guide base 10.

Assembly of the top guide assembly 100 is described with reference to FIG. 2. The guide arm 120 is pivotally connected to the top guide base 110 by press fitting the bore 300 of the guide arm 120 over the axles 210 of the top guide base 110.

The spring 150 is placed on the guide pin 140 and located within a channel formed in the guide arm 120. The spring 150 contacts the middle portion 360 of the guide arm 120 and the guide pin 140 extends through the slot 350 in the middle portion 360. The pin 140 is then secured to the slot 230 in the top guide base 110. As shown in FIG. 2, a left end of the spring 140 is supported by the middle portion 360 of the guide arm 120. The slot 250 in the middle portion 360 of the guide arm 120 is narrower than the diameter of the spring 140 so that the spring 140 does not extend through the slot 350 with the spring pin 140. Finally, the axle 400 of the guide wheel 130 is press fit into the bore 370 in the guide arm 120.

As shown in FIG. 2, the entire top guide assembly 100 is then press fit onto an upper corner of the sliding door 20. The guide arm 120 and guide wheel 130 are then pushed downward relative to the sliding door until the guide wheel aligns with the channel 50 in the upper track 30, at which point the guide arm 120 and guide wheel 130 are released to allow the guide wheel 130 to engage the channel 50.

The operation of the top guide assembly 100 is described with reference to FIGS. 1 and 2. As shown by the curved arrows in FIG. 2, the guide arm 120 and guide wheel 130 pivot upwardly and downwardly relative to the sliding door 20 and top guide base 110 about the guide arm axis 220. The compression spring 150 biases the guide arm 120 and guide wheel 130 upwardly (counterclockwise as shown in FIG. 2), which keeps the guide wheel 130 engaged with the channel 50 in the top track 30. If the top track 30 and bottom track spread away from each other, the guide arm 120 and guide wheel 130 move upwardly so that the guide wheel 130 remains engaged with the channel 50 despite the greater distance between the top track 30 and bottom track. Conversely, if the top track 30 and bottom track converge toward each other over any portion of the sliding door assembly 10, the guide arm 120 and guide wheel 130 move downwardly and compress the spring 150. Consequently, the guide wheel 130 remains engaged with the channel 50 and smoothly rolls over the channel 50 regardless of whether or not the top track 30 is perfectly parallel to the bottom track.

Figure 5:
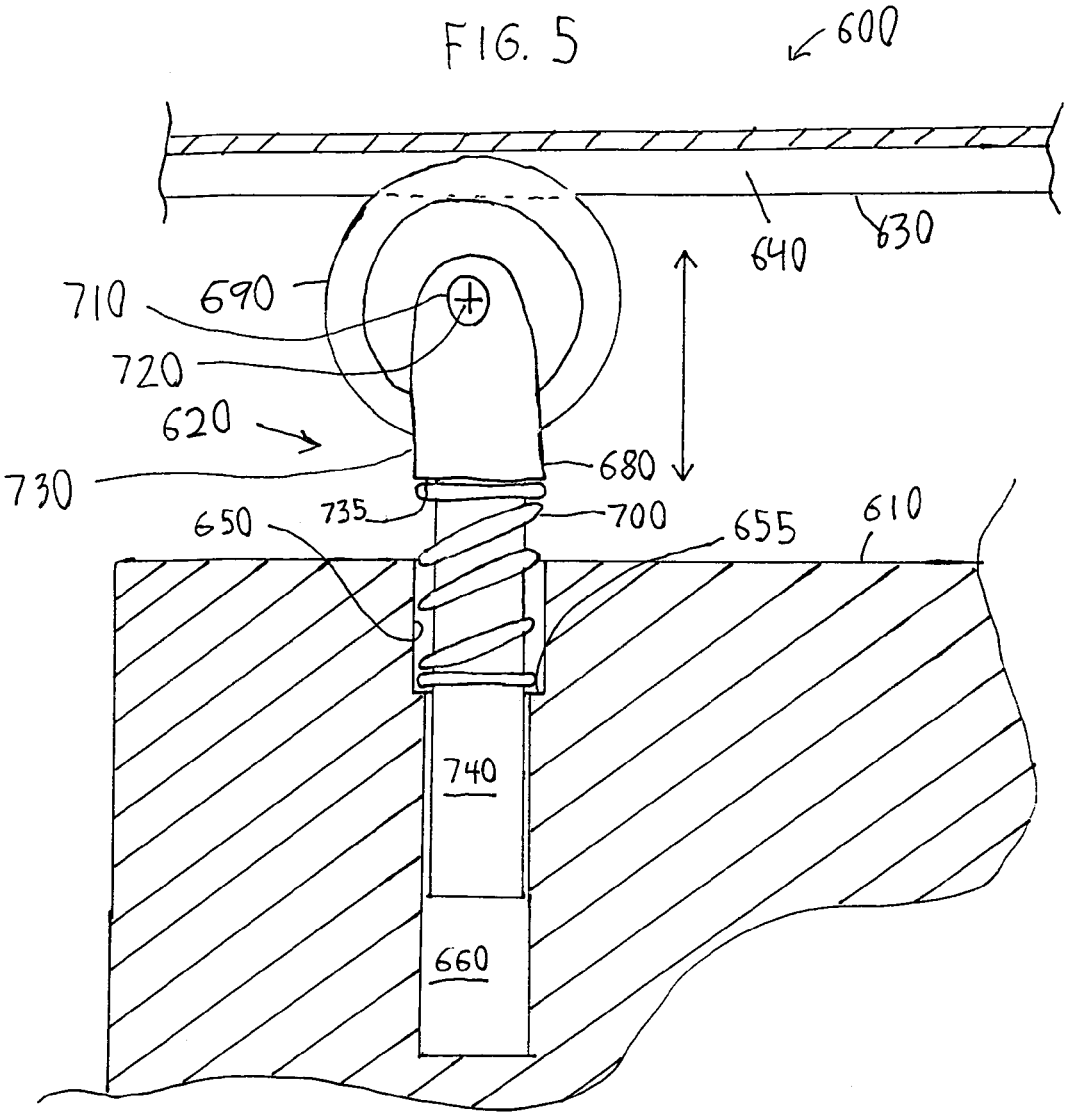
FIG. 5 is a partial side cut-away view of a top guide assembly according to an alternative embodiment of the present invention.
Figure 6:
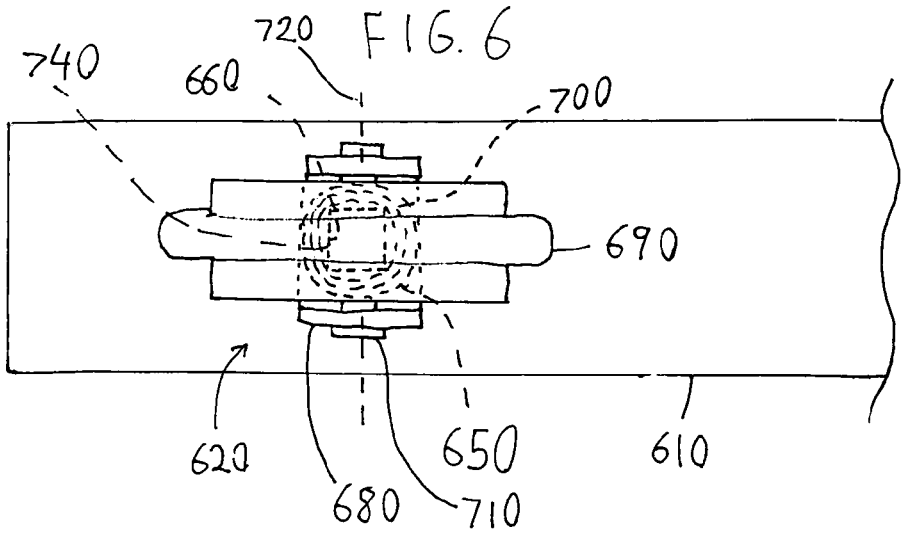
FIG. 6 is a top view of the top guide assembly in FIG. 5.

FIGS. 5 and 6 illustrate a sliding door assembly 600 according to an alternative embodiment of the present invention. The sliding door assembly 600 includes a sliding door 610, a top track 630, and a top guide assembly 620 that operatively connects the top track 30 to the sliding door 610.

The top track 630 is identical to the top track 30 and includes a channel 640 like the channel 50 described above.

A round bore 650 is formed in an upper portion of the sliding door 610 and extends downwardly from a top edge of the sliding door 610. As shown in FIG. 5, a square bore 660 extends downwardly into the sliding door 610 from the lower end of the round bore 650. The round and square bores 650, 660 are axially aligned. A shoulder 655 is defined by the round bore 650 at the intersection between the round bore 650 and the square bore 660.

In the illustrated embodiment, the round and square bores 650, 660 are formed directly in the sliding door 610. Alternatively, the round and square bores may be formed in a top guide base that mounts to a top or side of the sliding door.

As shown in FIGS. 5 and 6, the top guide assembly 620 includes a guide arm 680, a top guide wheel 690, a compression spring 700, and a pin 710.

The guide wheel 690 rotationally mounts to an upper, U-shaped portion 730 of the guide arm 680 via the pin 710, which extends through aligned bores in the guide arm 680 and guide wheel 690. The pin 710 defines a guide wheel axis 720 about which the guide wheel 690 rotates. The guide wheel axis 720 extends in a generally horizontal direction that is perpendicular to a direction of travel of the sliding door 610. As in the previously described embodiment, the guide wheel 690 engages the channel 640 formed in the top track 630 to guide the sliding door 610 along the top track 630.

While the illustrated rotational joint between the guide wheel 690 and the guide arm 680 comprises a pin 720, the rotational joint may alternatively comprise any other rotational joint. For example, as in the previously described embodiment, an axle formed on the guide wheel 690 could rotationally engage a slotted bore in the guide arm 680.

The guide arm 680 includes an upper U-shaped portion 730 and a lower square pin 740 that extends downwardly from the U-shaped portion 730. The guide wheel 690 extends into the U-shaped portion 730. A shoulder 735 is defined by the U-shaped portion 730 at the intersection between the U-shaped portion 730 and the square pin 740.

The square pin 740 extends downwardly into the round and square bores 650, 660 in the sliding door 610. The square bore 660 is slightly wider that the square pin 740 so that the guide arm 680 can freely slide upwardly and downwardly in the bore 660, but cannot pivot about a vertical axis relative to the bore 660. While the illustrated embodiment utilizes a square pin 740 and a square bore 660, the pin 740 and bore 660 may alternatively comprise a variety of other mating cross-sectional shapes. For example, the pin 740 and bore 660 may have cross-sectional shapes such as rectangles, "+" signs, etc. that allow relative axial movement but prevent relative pivotal movement.

The compression spring 700 fits over the square pin 740 and has an inner diameter that is slightly larger than a diagonal width of the square pin 740. The spring 700 extends into the round bore 650 and has an outer diameter that is slightly smaller than the diameter of the round bore 650. An upper end of the spring 700 engages the shoulder 735 on the guide arm 680. A lower end of the spring 700 engages the shoulder 655 of the round bore 650. Consequently, the spring 700 biases the guide arm 680 and guide wheel 690 upwardly (in the direction of the arrow in FIG. 5) to keep the guide wheel 690 engaged with the top track 630.

The top guide assembly 620 preferably includes a mechanism that limits the vertical movement of the guide arm 680 to prevent the guide arm 680 from disengaging from the sliding door 610 under the biasing force of the spring 700. For example, the mechanism may comprise a laterally extending pin that extends through a slot in the side of the sliding door 610 and into the square pin 740.

While the round bore 650 advantageously conceals part of the spring 700, the round bore 650 may be eliminated altogether without deviating from the scope of the present invention. In such an embodiment, the lower end of the spring 700 would abut the top edge of the sliding door 610.

The foregoing description is included to illustrate the operation of the preferred embodiments and is not meant to limit the scope of the invention. To the contrary, those skilled in the art should appreciate that varieties may be constructed and employed without departing from the scope of the invention, aspects of which are recited by the claims appended hereto.

What is claimed is:

1. A sliding door assembly comprising:

a rigid sliding door panel;

a top guide wheel guide arm, said door panel and guide arm and panel having a movable connection therebetween, said connection comprising a pivotal connection that defines a guide arm axis which is spaced from the guide wheel axis;

said guide arm being movably connected to an upper portion of the sliding door panel, said guide arm being movable relative to the sliding door panel in a vertical direction;

said top guide wheel being pivotally connected to said guide arm at a top guide wheel axis, said guide arm axis being spaced from said top guide wheel;

said guide wheel moving with the guide arm relative to the sliding door panel;

said top guide wheel axis said guide arm axis being parallel to each other; and a spring operatively extending between said sliding door panel and said guide arm to bias said guide arm and top guide wheel upwardly away from the sliding door panel.

2. The sliding door assembly of claim 1, wherein the top guide wheel axis extends in a lateral direction relative to the sliding door panel.

3. The sliding door assembly of claim 1, wherein there is an interference between the guide arm and the sliding door panel which limits the range of the pivotal movement of the guide arm relative to the sliding door panel.

4. The sliding door assembly of claim 1, wherein said top guide has a base mounted to the upper portion of the sliding door panel, and wherein the guide arm pivotally connects to the sliding door panel by a pivotal connection between the guide arm and the top guide base.

5. The sliding door assembly of claim 4 wherein said spring operatively extends between the top guide base and the guide arm to bias the guide arm and top guide wheel upwardly away from the top guide base.

6. The sliding door assembly of claim 1, wherein there is included an elongated top track adapted to be mounted to a substrate, the top track having an elongated guide wheel channel, the top guide wheel extends into the channel so that the channel guides the movement of the guide wheel along the top track.

7. The sliding door assembly of claim 6, where in the channel has opposing slides that provide lateral support to the sliding door panel.

8. The sliding door assembly of claim 6, further comprising said to bias the top guide wheel into the channel.

* * * * *